US006840489B2

(12) United States Patent
Barnes

(10) Patent No.: US 6,840,489 B2
(45) Date of Patent: Jan. 11, 2005

(54) METAL FRAME-CONTAINING WALL ARTICLE HANGER AND METHOD OF USE

(76) Inventor: Renny Barnes, 8228 Richmond Hwy., Alexandria, VA (US) 22309

( * ) Notice: Subject to any disclaimer, the term of this patent is extended or adjusted under 35 U.S.C. 154(b) by 0 days.

(21) Appl. No.: 10/419,780

(22) Filed: Apr. 22, 2003

(65) Prior Publication Data

US 2004/0211874 A1 Oct. 28, 2004

(51) Int. Cl.[7] ..... A47G 1/16

(52) U.S. Cl. ..... 248/475.1; 40/757; 248/217.3

(58) Field of Search ..... 248/475.1, 468, 248/490, 491, 216.1, 217.3, 218.3, 489, 217.1, 217.2, 220.2, 497, 216.4; 40/757

(56) References Cited

U.S. PATENT DOCUMENTS

| | | | | |
|---|---|---|---|---|
| D339,981 S | | 10/1993 | Barnes | |
| 5,267,718 A | * | 12/1993 | Sheehan | 248/475.1 |
| 5,328,139 A | | 7/1994 | Barnes | 248/475.1 |
| 5,588,629 A | | 12/1996 | Barnes | 248/475.1 |
| 5,758,858 A | | 6/1998 | Barnes | 248/544 |
| 6,095,478 A | | 8/2000 | Barnes | 248/475.1 |
| 2003/0178545 A1 | * | 9/2003 | Ernst | 248/475.1 |

* cited by examiner

*Primary Examiner*—Ramon O Ramirez
(74) *Attorney, Agent, or Firm*—Clark & Brody

(57) ABSTRACT

A wall article hanger for a metal frame and a method of using comprises an elongated spring plate that includes one or more angled prongs for support purposes and oppositely facing frame contact areas. The spring plate is flattened and inserted into a rear slot of the frame, such that the prong(s) extend outwardly. The frame can then be pressed against a wall surface so that the prong(s) penetrate the wall surface and support the wall article.

17 Claims, 3 Drawing Sheets

METAL FRAME-CONTAINING WALL ARTICLE HANGER AND METHOD OF USE

FIELD OF THE INVENTION

The present invention is directed to a wall article hanging device and method of use, and in particular, to a prong-containing flexible spring plate that can be inserted into the slot of a metal frame with the prongs extending outward from the frame for later penetration into a wall surface for wall article support.

BACKGROUND ART

In the prior art, a number of techniques are employed to hang a wall article such as a picture, painting, mirror, tapestry, etc. One such technique employs a nail or other member that is attached to the wall, whereby the nail acts as the support for the article to be hung. The article to be hung can then be fitted with a wire, and the wire is slipped over the protruding nail to support the article. The article can also use other types of hanging devices such as serrated plates that are attached to the back of a frame, with the nail engaging one of the serrations on the plate for frame support. The article can also be hung by attaching a hanger device having a loop, whereby the nail would engage the loop for article support.

Another class of wall article hanging devices are disclosed in U.S. Pat. Nos. D339,981, 5,328,139, 5,588,629, 5,758,858, and 6,095,478 to Barnes. These patents run counter to the conventional wall article hanging techniques that first attach an element to the wall, and then hang the wall article off that wall element. In the Barnes' patents, a hanging device is first attached to the wall article to be hung, and then the wall article is secured to a wall surface. Using the Barnes' device and method, there is no need for locating a nail or the 0.10 like at a predetermined location on the wall so as to position the wall article in the proper location. That is, the wall article itself is used for positioning in the proper site on the wall.

The Barnes' devices are also advantageous in that the wall article is secured in such a fashion that the article remains stationary after attachment, and the constant article leveling that goes on when a wire and nail are used is eliminated.

The hangers of the Barnes' patents are designed to be attached to a wall article frame using prongs of the device itself or fasteners. However, these attachment techniques are not particularly suited for wall articles that employ metal frames. These metal frames usually come in four pieces. Pieces forming the corners of the frame are generally held together using 1-shaped plates (or other suitable connectors), whereby each plate fits into a respective rear-facing slot of each frame piece. The plate is wedged in place by driving a screw through the plate and against a face of the frame. Other plates are used for hanging purposes, wherein the hanging plates engage slots in the side pieces of the frame using the same screw technique. The hanger plates may have a loop to receive a wire for hanging, or act as a base to attach a D-ring thereto.

Because certain frames are metal and the Barnes' hangers require fastening to the frame body, these types of hangers are not easily adapted for use with metal frames. Therefore, a need still exists to improve the present day ways to hang wall articles that employ metal frames.

The present invention responds to this need by providing a metal frame-containing wall article hanger that easily fits into the slot in a rear of the metal frame. The hanger includes protruding and angled prongs that allows the metal frame to be attached to a wall surface my merely pressing the frame against the wall surface so that the prongs enter the wall and retain the picture in place.

SUMMARY OF THE INVENTION

It is a first object of the present invention to provide an improved wall article hanging device.

Another object of the invention is to provide a hanging device that is adapted for metal frames.

Still another object of the invention is a method of hanging wall articles that utilize metal frames.

Other objects and advantages of the present invention will become apparent as a description thereof proceeds.

In satisfaction of the foregoing objects and advantages, the present invention provides an improved method of hanging a wall article on a wall surface. The method involves providing a curved elongated spring plate having a pair of prongs extending therefrom. The curved elongated spring plate is flattened, preferably by grasping the ends thereof and pulling downward. Once the height of the plate is reduced, it can be inserted into the slot in a top or bottom piece of the metal frame. Once inserted, the pair of prongs extends outward from the slot. The wall article is then positioned near a desired location on a wall, and then pushed towards the wall such that the prongs penetrate a wall surface and support the wall article on the wall. Once inserted, the plate can be removed by reversing the steps; first flattening the plate, and then withdrawing it from the slot.

The insertion step can involve either the top of bottom pieces of the frame or a combination thereof. The plate is preferably configured such that one portion contacts one side of the slot with at least two other portions contacting an opposite side of the slot.

The plate can employ one or more than one prong. When a plate with one prong is used, a pair of plates are employed for hanging purposes. When the plate has a pair of prongs, one or more plates can be employed for hanging.

When one prong is used, the prong preferably extends from a middle portion of the plate, the middle portion also having one of the frame contact areas. The opposing frame contact areas are disposed on either side of the middle portion of the plate.

When a pair of prongs are used, the middle portion still retains a frame contact area. The prongs are disposed on either side of the middle portion, and the opposing frame contact portions are positioned adjacent the prongs, either between the prongs and the middle portion, or adjacent ends of the plate.

The invention also entails the spring plate itself having the one or two prong configuration. In either embodiment, the ends of the plate can contain wing portions, which are displaced in a height direction from the opposing frame contact areas to provide a grasping surface for the flattening step. The wing ends are preferably curved so as to be displaced from an adjacent prong or frame contact portion of the plate.

In another aspect of the invention, the device can utilize a wire instead of a plate, either being characterized as a body for description purposes. The wire can be shaped generally the same as the plate, with the ends of the wire acting as the prongs for insertion into a wall.

BRIEF DESCRIPTION OF THE DRAWINGS

Reference is now made to the drawings of the invention wherein.

DESCRIPTION OF THE PREFERRED EMBODIMENTS

The present invention offers significant advantages in the field of hanging wall articles. The invention overcomes the problems of trying to hang metal frame-containing wall articles with hanging devices designed to penetrate the wall article frame. With the inventive wall article hanging device, there is no need to use wires and/or nails in a wall to hang a wall article such as a picture. With the inventive hanging device, one merely has to insert the inventive hanger into the rear facing slot in the metal frame, and press the frame towards the wall surface selected for mounting. No measuring or guessing the location of nails in the walls is ever required.

Figure 1:
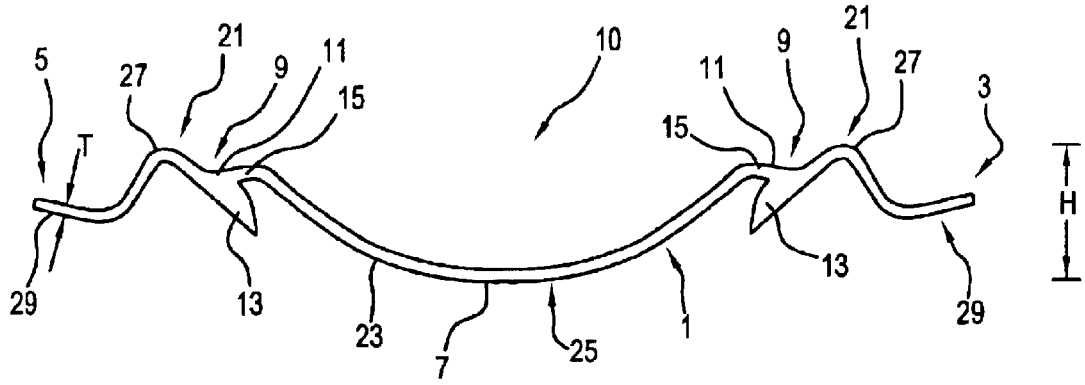
FIG. 1 is a side view of one embodiment of the invention, enlarged to show detail.
Figure 2:
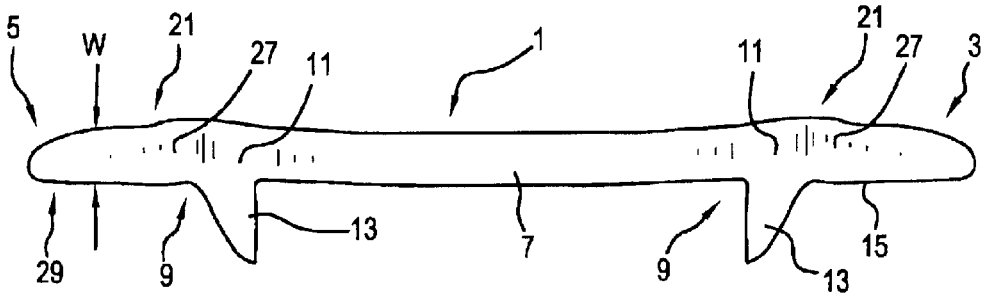
FIG. 2 is a top view of the embodiment of FIG. 1.
Figure 3:
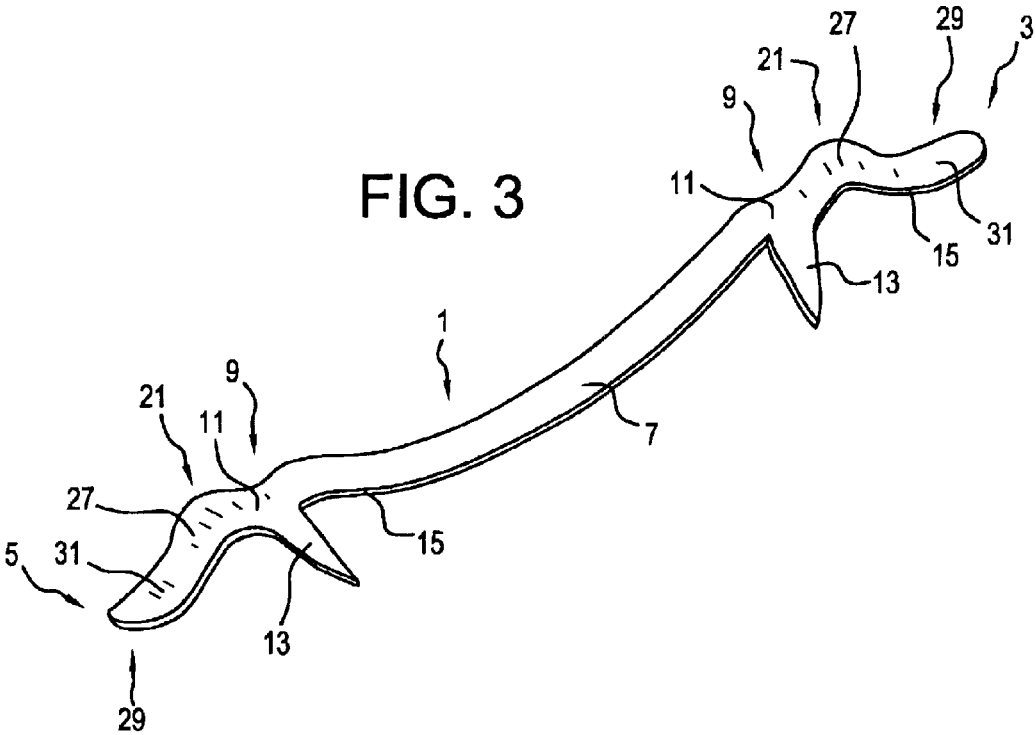
FIG. 3 is a perspective view of the FIG. 1 embodiment.

With reference to FIGS. 1–3, the inventive wall article hanging device or hanger is designated by the reference numeral 10. The device is essentially an elongated spring plate 10 that can be flattened for insertion into a metal frame slot as detailed below.

The spring plate 10 has an elongate body 1 having ends 3 and 5. The body 1 can be considered to be made up of sections or portions with a middle portion comprising an arcuate portion 7. The arcuate portion 7 has on either end thereof a prong portion 9. The portion 9 comprises a flat plate portion 11 with a prong 13 extending at a particular angle with respect to a side surface 15 of the plate portion 11. The side edge surface 15, when the spring plate 10 is installed for mounting purposes, is generally parallel to a wall mounting surface so that the prong 13 is angled downwardly when a side surface of the spring plate 10 is facing a wall surface. The angling of the prongs tracks the angling of the prongs used in the Barnes' hanging devices as discussed above. A further description of the manner in which the prongs act as support members is not deemed necessary for understanding the function of the prongs in supporting the wall article. Each of the Barnes' patents is hereby incorporated in its entirety by reference.

The spring plate 10 also has a pair of frame contact portions 21 or humps when compared to each adjacent prong portion 9. Each frame contact portion 21 is located adjacent a prong portion 9, with the middle arcuate portion 7 positioned between the two prong portions and the two frame contact portions 21.

Continuing to refer to the middle arcuate portion 7, this portion has a convex surface 23, a segment thereof that constitutes a center region forming a frame contact area 25. Each of the frame contact portions 21 is curved or humped to form a convex frame contact area 27, the areas 27 facing opposite the convex area at 25 of the middle arcuate portion 7.

The spring plate 10 is preferable made of a spring material, such as a spring steel, having a plate thickness "T", see FIG. 1, and width "W", see FIG. 2, and clip height "H", see FIG. 1. The clip height "H" is measured from the contact area 25 of the arcuate portion 7 to the contact area 27 of the frame contact portions 21. The dimensions and uniformity thereof can vary; the embodiment of FIG. 2 shows the middle-arcuate portion with a necked width less than a width of the portions 9 and 21. Exemplary dimensions are 3 inches in length, 3/16 inches in width (necked to 1/8 inch at the middle portion if desired), height of about 1/2 inch, and plate thickness of about 1/32 inch. The plate can be made by stamping/cutting/forming operations or any other known manufacturing techniques.

The spring plate 10 also has wing ends 29, each of which forms a concave surface 31, see FIG. 3. The wing ends 29 are curved in shape so that the grasping surface is displaced from the contact areas 27 for ease of gripping. The wing ends 29 assist in flexing or flattening the spring plate 10 during it installation in and removal from a metal frame.

Figure 4:
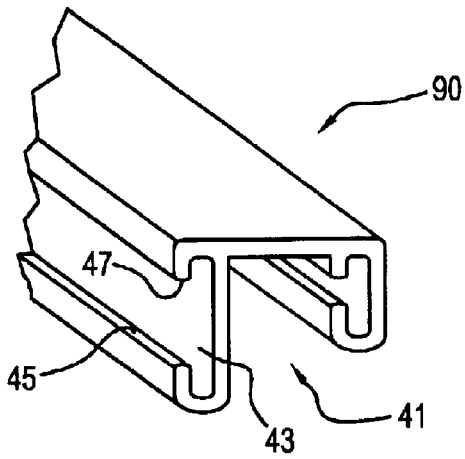
FIG. 4 shows a segment of a metal frame for use with the inventive hanger.

In operation and referring to FIG. 4, a section of an exemplary metal frame is designated by the reference numeral 40. The frame has a first slot 41, which is sized to receive the picture or other wall article to be mounted. A second or rear-facing slot 43 is provided. The slot 43 functions to receive L-shaped corner plates (not shown) for connecting the two top and the two side frame pieces together.

The slot 43 represents a slot in the top or bottom piece, the horizontal pieces of the frame. The slot has opposing surfaces 45 and 47.

Figure 5:
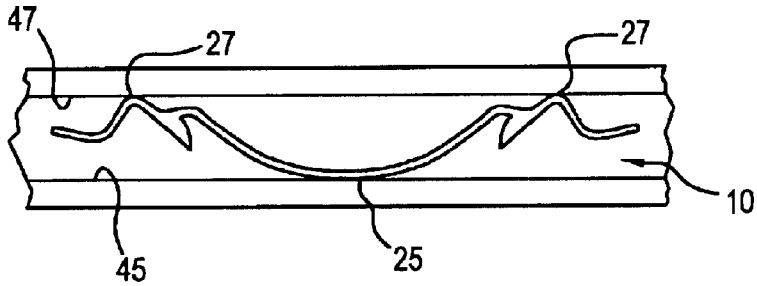
FIG. 5 is a rear view of an exemplary use wherein the embodiment of FIG. 1 is inserted in a metal frame for hanging purposes.
Figure 6:
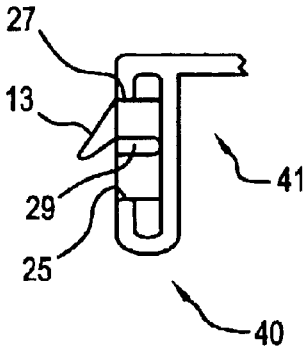
FIG. 6 is a side view of the FIG. 5 arrangement.
Figure 7:
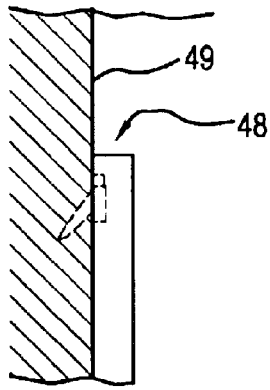
FIG. 7 is a side view of a wall article mounted to a wall surface using the hanger of FIG. 1.

The spring plate 10 is inserted into the slot 43 by first grasping the wing ends 29, and flattening the spring plate 10 against its natural and relaxed state as would be seen in FIG. 1. This flattening reduces the height "H" of the clip so that it can be inserted into the slot 43. Releasing the wing ends 29 allows the spring plate 10 to expand and bias against the surfaces 45 and 47. FIG. 5 shows the spring plate 10 inserted into the slot 43. With the spring plate retained in place by the spring bias, the prongs 13 extend outwardly from a rear of the frame, see FIG. 6. With the prongs 13 extending outwardly from the edge of the spring plate 10, and positioned, for example in a top piece of the frame, the framed wall article 48 can be pressed into a wall mounting surface 49 so that the prongs 13 penetrate the wall and support the wall article, see FIG. 7.

Because of the presence of the pair of prongs, the wall article maintains its horizontal position, and the constant adjustment required when using wires is eliminated. Further, since the wall article merely has to be pressed against the wall at a desired location, there is no need to measure for the location of a nail or brad that would support a wire attached to the frame or engage a ring mounted on a back of the wall article. While one spring plate is shown to support a frame, more than one could be employed if the wall article was heavy, with both spring plates in a top frame piece, or one in a top piece and one in a bottom frame piece. Further, although the wing ends are shown, they are optional. Without the wing ends, the contact portions 21 could act as the ends of the plate 10 and as a part to grab for flattening.

While the prong portions 9 are shown adjacent the ends of the middle arcuate portion 7, the frame contact portions 21 could be adjacent the ends of middle arcuate portion 7, and the prongs 13 could be located outward of the contact portions 21, if so desired, (the positions of portions 9 and 21 are reversed.)

Referring again to FIG. 2, the prongs 13 are also angled slightly inwardly toward a center of the spring plate to further enhance holding power once the prongs have penetrated a wall surface. In addition, the flattening of the plate drives the distal end of the prongs further inward to better the holding power of the hanger.

Figure 8:
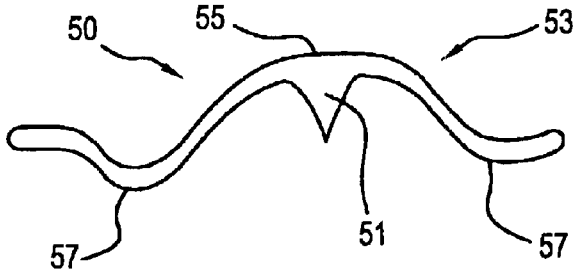
FIG. 8 is a schematic of an alternative embodiment of the invention using one prong.

In another embodiment and referring to FIG. 8, a schematic representation of a one prong clip 50 is shown, wherein a prong 51 would be extend from an edge of an arcuate middle portion 53. The area 55 would serve as one frame contacting area. The oppositely facing contact areas are identified as 57. In this embodiment, a pair of the clips 50 would be used so that at least two prongs enter the wall for mounting and maintain the frame position over time, the prongs spaced apart by the distance between the two spring plates 50 as mounted on the upper and/or lower frame piece.

Figure 9:
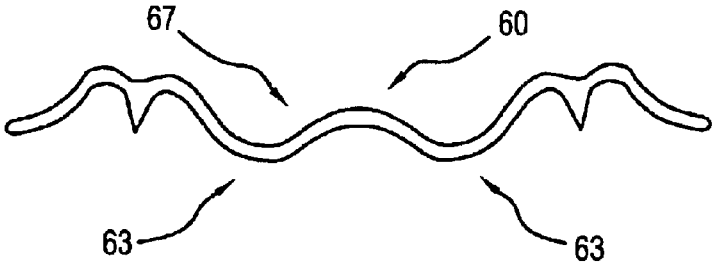
FIG. 9 is a schematic of yet another alternative embodiment of the invention.

FIG. 9 shows yet another embodiment of the invention wherein the plate is designated by the reference numeral 60. The middle portion 61, rather than being arcuate as in FIG. 1, is "W" shaped to form a pair of contact areas 63. In another variation, although not illustrated, the prongs 65 should be located at the areas 63, similar to the prong location of FIG. 8. In this version, two prongs are used for one plate, just that the prongs are associated with the middle portion rather than the outer portions as shown in FIG. 1.

Figure 10A:
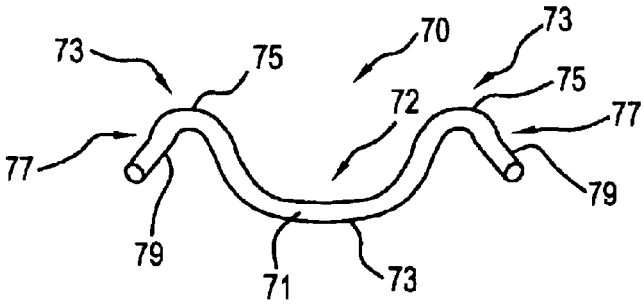
FIG. 10A is a perspective view of a further embodiment of the invention wherein a wire is employed in replacement of the plate of FIG. 1.
Figure 10B:
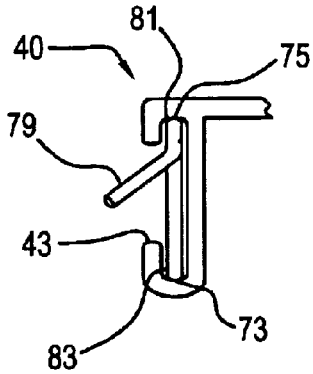
FIG. 10B is a side view of the device of FIG. 10A in an exemplary use.

FIGS. 10A and 10B show an additional embodiment of the invention as reference numeral 70. Instead of a plate as a body of the device, the embodiment 70 employs a spring wire 71, which is shaped to both be secured to the frame and allow for wall penetration for hanging purposes. The device 70 has a first curved portion 72 with a slot contacting area 73. Two other curved portions 73 are found on either side of curved portion 72. Each curved portion 73 has a slot contacting area 75. At the terminus 77 of each curved portion 73 is a prong 79, which acts as a prong to be inserted into a wall for hanging purposes. With particular reference to FIG. 10B, the curved portions 72 and 73 are sized to rest within the slots 81 and 83 of the frame 40. This contrasts with the plate resting on slots surfaces 45 and 47 as shown in FIG. 40. In use, the hanger 70 is flattened by grasping the prongs 79 so that the curved portions 72 and 73 can be inserted into frame slots 81 and 83. Releasing the prongs 79 allows the spring wire to expand so that the hanger is engaged in the frame for hanging purposes. The process is reversed by grasping the prongs 79 for removal purposes. It should also be understood that the wire embodiment 70 can also use the variations shown with the plate embodiment, e.g., a "W" configuration, inward bending of the prongs, etc.

As such, an invention has been disclosed in terms of preferred embodiments thereof which fulfills each and every one of the objects of the present invention as set forth above and provides a new and improved wall article hanging device and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A method of hanging a metal-framed wall article wherein the metal frame has a slot running along a rear face thereof comprising:

providing a curved elongated spring body having a pair of prongs extending therefrom, flattening the curved elongated spring body and inserting the curved elongated spring body into the slot in a top or bottom piece of the metal frame such that the pair of prongs extend outward from the slot;

positioning the wall article near a desired location on a wall, and pushing the wall article towards the wall such that the prongs penetrate a wall surface and support the wall article on the wall.

2. The method of claim 1, wherein the curved elongated spring body is inserted into a top portion of the metal frame.

3. The method of claim 1, wherein the curved elongated spring body is inserted into a bottom portion of the metal frame.

4. The method of claim 1, further comprising the step of flattening the curved elongated spring body while in the slot and removing the curved elongated spring body from the slot.

5. The method of claim 1, wherein the curved elongated spring body is curved such that at least one portion contacts one side of the slot with at least two other portions contacting an opposite side of the slot.

6. The method of claim 1, wherein curved elongated spring body is a plate or a wire.

7. A method of hanging a metal-framed wall article wherein the metal frame has a slot running along a rear face thereof comprising:

providing a pair of curved elongated spring plates, each having one prong extending therefrom, flattening each curved elongated spring plate and inserting each curved elongated spring plate into the slot in a top or bottom piece of the metal frame such that the prong of each curved elongated plate extends outward from the slot;

positioning the wall article near a desired location on a wall, and pushing the wall article towards the wall such that the prongs penetrate a wall surface and support the wall article on the wall.

8. The method of claim 7, wherein the curved elongated spring plate is curved such that one portion contacts one side of the slot with at least two other portions contact an opposite side of the slot, the prong extending from an edge of the one portion.

9. A metal frame wall article hanger comprising:

an elongated spring body with upper and lower flat faces defining a plane, and opposing side edges, the upper and lower faces following a curved configuration, and forming oppositely facing metal frame slot contacting areas, one of the opposing side edges of the elongated spring body lying in a plane and having at least one prong extending at an angle on the same plane defined by the upper and lower faces for penetration into a wall surface for wall article hanging.

10. The hanger of claim 9, wherein the elongated spring body is a wire or a plate and has a pair of prongs.

11. The hanger of claim 9, wherein the elongated spring body has a middle arcuate portion with one metal frame slot contacting areas, and a pair of outer slot contacting portions having the oppositely faced metal frame slot contacting areas, the middle arcuate portion positioned between the outer frame contacting portion, and each prong being positioned between an end of the middle arcuate portion and one of the outer frame contacting portions.

12. The hanger of claim 11, wherein the elongated spring body is a plate and has first and second ends, each of the first and second ends having a wing portion to facilitate flattening of the elongated spring plate for insertion into the metal frame slot.

13. The hanger of claim 9, wherein the elongated spring body is a plate having first and second ends displaced from the oppositely facing metal frame slot contacting areas, each of the first and second ends facilitating flattening of the elongated spring plate for insertion into the metal frame slot.

14. The hanger of claim 9, wherein the elongated spring body has a middle arcuate portion with one metal frame slot contacting areas, and a pair of outer frame contacting portions having the oppositely faced metal frame contacting areas, the middle arcuate portion positioned between the outer frame contacting portion and containing the prong.

15. The metal frame wall article hanger of claim 9, wherein the curved configuration is one of an arcuate shape or a W-shape.

16. The hanger of claim 9, wherein the elongated spring body has a middle curved portion with at least two metal frame slot contacting areas, and a pair of outer frame contacting portions having the oppositely faced metal frame slot contacting areas, the middle arcuate portion positioned between the outer frame contacting portion and containing the prong.

17. A metal frame wall article hanger comprising an elongated spring plate having a curved configuration, the curved configuration forming oppositely facing metal frame slot contacting areas, the elongated spring plate having a pair of prongs extending from an edge of the plate and being angled with respect to a face of the edge, the elongated spring plate has a middle arcuate portion with one of the metal frame slot contacting areas, and a pair of outer frame contacting portions having the oppositely faced metal frame contacting areas, the middle arcuate portion positioned between the outer frame contacting portion, and each prong being positioned between an end of the middle arcuate portion and one of the outer frame contacting portions, the elongated spring plate having first and second ends displaced from the outer frame contacting portions, each of the first and second ends facilitating flattening of the elongated spring plate for insertion into the metal frame slot.

* * * * *